US009051160B2

(12) United States Patent
Zheng

(10) Patent No.: US 9,051,160 B2
(45) Date of Patent: Jun. 9, 2015

(54) ELECTRIC CAPSTAN

(75) Inventor: Mingkui Zheng, Ningbo (CN)

(73) Assignee: NINGBO CHIMA WINCH CO., LTD., Ningbo (CN)

( * ) Notice: Subject to any disclaimer, the term of this patent is extended or adjusted under 35 U.S.C. 154(b) by 0 days.

(21) Appl. No.: 13/183,380

(22) Filed: Jul. 14, 2011

(65) Prior Publication Data

US 2012/0110992 A1 May 10, 2012

(30) Foreign Application Priority Data

Nov. 9, 2010 (CN) ..... 2010 2 0612033 U
Jan. 20, 2011 (CN) ..... 2011 2 0018109 U

(51) Int. Cl.
*B66D 1/08* (2006.01)
*B66D 1/14* (2006.01)

(52) U.S. Cl.
CPC ..... *B66D 1/14* (2013.01)

(58) Field of Classification Search
USPC ..... 254/342, 345, 360, 361, 365
See application file for complete search history.

(56) References Cited

U.S. PATENT DOCUMENTS 1,597,198 A * 8/1926 Howell ..... 192/69.81
1,642,230 A * 9/1927 Davis ..... 74/665 H
1,923,694 A * 8/1933 Weaver ..... 254/275
2,795,396 A * 6/1957 Davidson ..... 254/273
3,231,913 A * 2/1966 Reinhardt ..... 470/66
3,744,760 A * 7/1973 Uher ..... 254/351
3,850,263 A * 11/1974 Chin ..... 182/236
3,927,580 A * 12/1975 Fawcett ..... 74/810.1
3,981,208 A * 9/1976 Moses ..... 74/810.1
4,054,266 A * 10/1977 Guangorena ..... 254/345
4,123,040 A * 10/1978 Kuzarov ..... 254/342
4,162,059 A * 7/1979 Fletchall ..... 254/358
4,390,147 A * 6/1983 Zuckerman ..... 242/255
4,426,064 A * 1/1984 Healy ..... 254/342
4,493,396 A * 1/1985 Borgia ..... 182/238
4,545,567 A * 10/1985 Telford et al. ..... 254/344
4,974,814 A * 12/1990 Cundy ..... 254/345
5,368,279 A * 11/1994 Ottemann et al. ..... 254/342
5,584,207 A * 12/1996 Paul et al. ..... 74/89.22
5,871,069 A * 2/1999 Carmitchel ..... 187/231
6,042,086 A * 3/2000 Roberts ..... 254/344
6,241,215 B1 * 6/2001 Gersemsky et al. ..... 254/342
6,427,982 B1 * 8/2002 Sugimachi ..... 254/360
6,554,255 B2 * 4/2003 Fujikawa ..... 254/358
7,017,887 B1 * 3/2006 Verakis ..... 254/342
7,159,852 B2 * 1/2007 Dow et al. ..... 254/342
7,513,485 B2 * 4/2009 Lee ..... 254/346
7,575,222 B2 * 8/2009 Hamilton ..... 254/342
7,588,233 B2 * 9/2009 Roe et al. ..... 254/346
8,167,090 B2 * 5/2012 Michael ..... 182/231
2001/0013593 A1 * 8/2001 Buhlmayer et al. ..... 254/342
2002/0171072 A1 * 11/2002 Tso-Kuo ..... 254/345
2003/0111654 A1 * 6/2003 Huang ..... 254/344
2005/0072965 A1 * 4/2005 Sanders et al. ..... 254/361
2006/0249719 A1 * 11/2006 Lesko ..... 254/342
2008/0017838 A1 * 1/2008 Ball et al. ..... 254/342
2010/0127229 A1 * 5/2010 Kverneland et al. ..... 254/356
2011/0180098 A1 * 7/2011 Lange et al. ..... 134/6

* cited by examiner

*Primary Examiner* — Emmanuel M Marcelo
*Assistant Examiner* — Michael Gallion
(74) *Attorney, Agent, or Firm* — Pearne & Gordon LLP

(57) ABSTRACT

An electric capstan that is able to save power and make use more convenient. The electric capstan includes an air pump, a motor, a reduction gear and a winching roller, and further includes an engagement-disengagement gear, wherein the input shaft of the air pump is connected to or separated from the output shaft of the motor by the engagement-disengagement gear.

13 Claims, 2 Drawing Sheets

ELECTRIC CAPSTAN

CROSS-REFERENCE(S) TO RELATED APPLICATION(S)

This application claims priority to Chinese Patent Application No. 201020612033.9, filed Nov. 9, 2010, and to Chinese Patent Application No. 201120018109.X, filed Jan. 20, 2011, each of which is hereby incorporated by reference in the present disclosure in its entirety.

BACKGROUND

1. Field

The present disclosure relates generally to capstans, and more specifically to electric capstans.

2. Description of Related Art

Electric capstans are mainly used in off-road vehicle, agricultural vehicle, barge and other special vehicles, and are used as a self-protection device and a traction device for a vehicle or a ship. In the case of driving vehicles or ships for purpose of traction operation and rescue operation (including self-rescue operation), electric capstans act an important part.

There is an electric capstan in the related art, which includes an air pump, a motor, a reduction gear and a winching roller, wherein the output shaft of the motor at one end thereof is connected to the input shaft of the air pump, the output shaft of the motor at the other end thereof is connected to the reduction gear, and then the reduction gear is connected to the winching roller. This can accomplish a multi-functional electric capstan, namely traction function and inflation function. However, since output shaft of the motor of the electric capstan is directly connected to the input shaft of the air pump, the motor may always drive the air pump. As a result, when inflation is not required, this causes much power to be consumed and wasted, which is unexpected and brings the user inconvenience.

BRIEF SUMMARY

One object of the present disclosure is to provide an electric capstan which is able to save power and make use convenient.

In one embodiment, the object of the present disclosure can be accomplished using the following configuration: An electric capstan of the disclosure includes an air pump, a motor, a reduction gear and a winching roller, and further includes an engagement-disengagement gear, wherein the input shaft of the air pump is connected to or separated from the output shaft of the motor by the engagement-disengagement gear.

Compared with the related art, the present disclosure, with such above configuration, has following advantages. The electric capstan according to the present disclosure further includes an engagement-disengagement gear, wherein the input shaft of their air pump is connected to or separated from the output shaft of the motor by the engagement-disengagement gear. As a result, this can allow the user to start or stop the air pump arbitrarily, so that the present disclosure has advantages in saving power and convenient use.

As a modification, the engagement-disengagement gear includes a clutch and a lever that is able to engage or disengage the clutch, wherein the clutch has a groove, the lever at the end thereof has an eccentric and axial protrusion which can be embedded in the groove of the clutch, and the lever is rotatably attached to the housing of the clutch. This engagement-disengagement gear has a simple and reliable structure, high transmission efficiency and easy manipulation, which is advantageous to implement the electric capstan according to the present disclosure and improve the performance thereof.

As a further modification, the electric capstan according to the present disclosure further includes a transmission mechanism, the input end of which is connected to the output end of the motor, and the output end of which is located on the side face of motor and connected to the input shaft of the air pump. As a result, since the air pump is located on the sideface of the motor, the dimension of the electric capstan in the axial direction thereof can greatly reduce, that is the dimension of the electric capstan in the lengthwise direction thereof can greatly reduce, and therefore, the electric capstan according to the present disclosure has an advantage that it can be mounted on an object which provides a narrow mounting place.

As a further modification, the transmission mechanism is a gear transmission mechanism which includes a bracket, a first gear, a second gear and a third gear, wherein the bracket is connected to the housing of the motor, the output shaft of the motor extends into the bracket, the housing of the air pump is connected with the bracket, and the input shaft of the air pump extends into the bracket; the connection of the input end of the transmission mechanism and the output shaft of motor means the connection of the first gear and the output shaft of motor; the second gear is mounted on the bracket; the connection of the output end of the transmission mechanism and the input shaft of the air pump means the connection of the third gear and the input shaft of the air pump; the first gear, the second gear and the third gear are engaged successively. As a result, since the three gears constitute the gear transmission mechanism, the electric capstan according to the present disclosure has a simple structure and reduced weight, and therefore, it is easy to be mounted on transportation such as a vehicle.

As a further modification, the air pump is located above the sideface of the motor. As a result, this can make the whole structure of the electric capstan more compact and mounting of the air pump more convenient.

As a further modification, a speed change mechanism may be arranged between the output end of the transmission mechanism and the input shaft of the air pump. The output end of the transmission mechanism, the speed change mechanism and the input shaft of the air pump are connected successively. As a result, through the speed change mechanism, the revolution speed outputted by the output end of the transmission mechanism can match further more air pumps available from market, thus increasing productive efficiency and reducing cost.

As a further modification, the engagement-disengagement gear is an engagement-disengagement handle that can be operated so as to move the second gear in the axial direction of the revolution shaft thereof and further engaged with or disengaged from the first gear, wherein the engagement-disengagement handle is mounted on the bracket, and the operational end of the engagement-disengagement handle is located on the side of the second gear. This engagement-disengagement gear has a simple and reliable structure, reduced cost and easy manipulation. Furthermore, the engagement-disengagement gear is arranged on the transmission mechanism, thus making the whole structure of the electric capstan more compact. This is advantageous to implement the electric capstan according to the present disclosure and improve the performance thereof.

Figure 1:
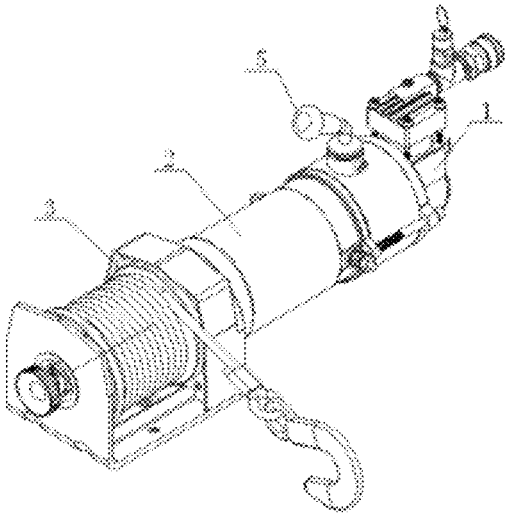
FIG. 1 is an exemplary structural view of the electric capstan according to the first embodiment of the present disclosure.

In the figures, reference numeral 1 indicates an air pump, reference numeral 2 indicates a motor, reference numeral 3 indicates a winching roller, reference numeral 4 indicates a clutch, reference numeral 5 indicates a lever, reference numeral 6 indicates a bracket, reference numeral 7 indicates a first gear, reference numeral 8 indicates a second gear, reference numeral 9 indicates a third gear, reference numeral 10 indicates an engagement-disengagement handle, reference numeral 91 indicates a reduction gear, reference numeral 92 indicates an input shaft, and reference numeral 93 indicates an output shaft.

DETAILED DESCRIPTION

The following description sets forth exemplary methods, parameters and the like. It should be recognized, however, that such description is not intended as a limitation on the scope of the present disclosure but is instead provided as a description of exemplary embodiments.

The details of the present disclosure are set forth in the accompanying drawings and the embodiments below.

First Embodiment

In the first embodiment of the present disclosure, an electric capstan includes an air pump 1, a motor 2, a reduction gear and a winching roller 3. The electric capstan further includes an engagement-disengagement gear, and the input shaft 92 of the air pump 1 is connected to or disconnected from the output shaft 93 of the motor 2 by the engagement-disengagement gear. The motor 2, the reduction gear 91 and the winching roller 3 are available from prior art, and thus the descriptions thereof are omitted.

The engagement-disengagement gear includes a clutch 4 and a lever 5 that is able to engage or disengage the clutch 4. The clutch 4 has a groove, and the lever 5 at the end thereof has an eccentric and axial protrusion which can be embedded in the groove of the clutch. The lever 5 is rotatably attached to the housing of the clutch 4.

A speed change mechanism, which is able to increase or reduce speed and which may be conventionally available from the market, may be arranged inside the air pump 1. For example, the rotation speed of the motor 2 relates to the traction power range of the electric capstan, and therefore, in this embodiment, the electric capstan is designed as follows:

When the traction capacity range of the electric capstan is between 1500-6000 pounds, the air pump 1 is unnecessarily provided with the reduction mechanism.

When the traction capacity range of the electric capstan is between 8000-13000 pounds, the air pump 1 is necessarily provided with the reduction mechanism.

Figure 2:
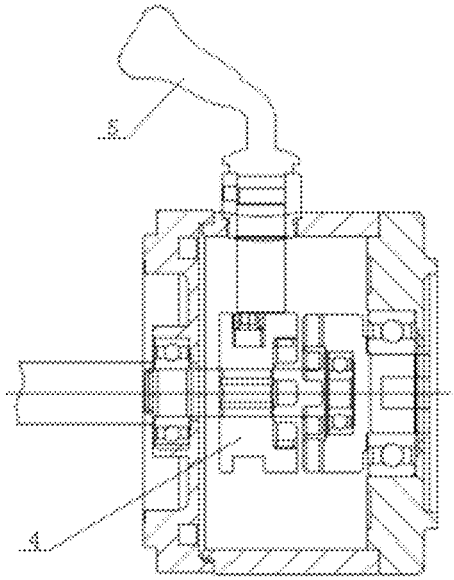
FIG. 2 is an exemplary cross-sectional view, in enlarged manner, showing the engagement-disengagement gear of the electric capstan according the first embodiment of to the present disclosure.

In the first embodiment, the air pump 1, the motor 2, the engagement-disengagement gear, the reduction mechanism and winching roller 3 align in a same axis. Such above configuration is shown in FIG. 1 or 2.

Second Embodiment

In the second embodiment of the present disclosure, an electric capstan includes an air pump 1, a motor 2, a reduction gear 91 and a winching roller 3. The electric capstan further includes an engagement-disengagement gear, and the input shaft 92 of the air pump 1 is connected to or disconnected from the output shaft 93 of the motor 2 by the engagement-disengagement gear.

Figure 3:
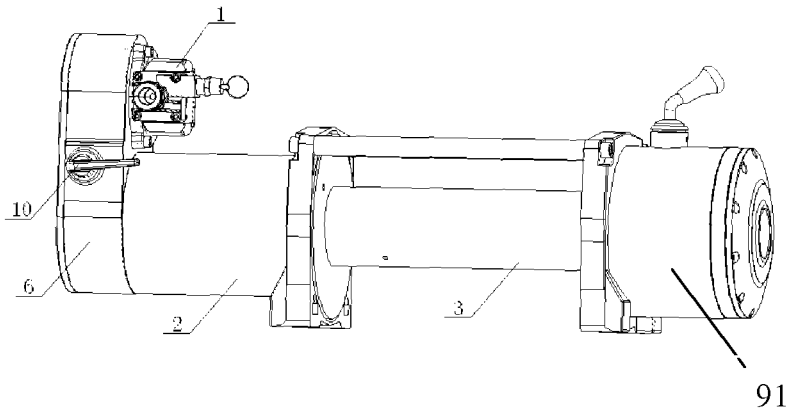
FIG. 3 is an exemplary structural view of the electric capstan according to the second embodiment of the present disclosure.
Figure 4:
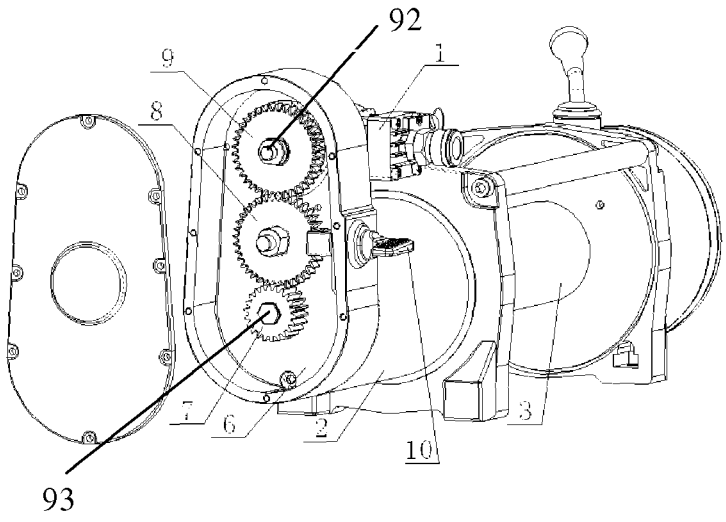
FIG. 4 is another exemplary structural view of the electric capstan according to the second embodiment of the present disclosure.

The electric capstan further includes a transmission mechanism, the input end of which is connected to the output shaft 93 of the motor 2, and the output end of which is located on the side face of motor 2 and connected to the input shaft 92 of the air pump 1. The output shaft 93 of the motor 2 is also connected to the reduction gear 91, and then the reduction gear is connected to the winching roller 3. The motor 2, the reduction gear and the winching roller 3 are available from prior art, and thus the descriptions thereof are omitted. Such above configuration is shown in FIG. 3 or 4.

The transmission mechanism is a gear transmission mechanism that includes a bracket 6, a first gear 7, a second gear 8 and a third gear 9. The bracket 6 is connected to the housing of the motor 2, the output shaft 93 of the motor 2 extends into the bracket 6, the housing of the air pump 1 is connected with the bracket 6, and the input shaft 92 of the air pump 1 extends into the bracket 6. The connection of the input end of the transmission mechanism and the output shaft of motor 2 means the connection of the first gear 7 and the output shaft of motor 2. The second gear 8 is mounted on the bracket 6. The connection between the output end of the transmission mechanism and the input shaft 92 of the air pump 1 means the connection of the third gear 9 and input shaft 92 of the air pump 1. The first gear 7, the second gear 8 and the third gear 9 are engaged successively.

The engagement-disengagement gear is an engagement-disengagement handle 10 that can be operated so as to move the second gear 8 in the axial direction of the revolution shaft thereof and further engaged with or disengaged from the first gear 7, wherein the engagement-disengagement handle 10 is mounted on the bracket 6, and the operational end of the engagement-disengagement handle 10 is located on the side of the second gear 8.

The air pump 1 is located above the side face of motor 2, and the axis of the input shaft 92 of the air pump 1 is in parallel with the axis of the output shaft 93 of the motor 2.

A speed change mechanism (not shown), which is able to increase or reduce speed and which may be available from the related art, may be arranged between the output end of the transmission mechanism and the input shaft 92 of the air pump 1. The output end of the transmission mechanism, the speed change mechanism and the input shaft 92 of the air pump 1 are connected successively. In addition to provision of the speed change mechanism between the output end of the transmission mechanism and the input shaft 92 of the air pump 1, in this embodiment, a speed change mechanism built-in air pump 1 as the first embodiment may be adopted.

What is claimed is:

1. An electric capstan comprising:

an air pump;

a motor;

a reduction gear;

a winching roller;

an engagement-disengagement handle;

a transmission mechanism; and a speed change mechanism, wherein an input shaft of the air pump is connected to or disconnected from a first output shaft of the motor by the engagement-disengagement handle, and wherein the motor comprises a second output shaft that is connected to the winching roller, and wherein the transmission mechanism comprises a bracket, a first gear, a second gear and a third gear, the bracket is connected to the housing of the motor, the first output shaft of the motor extends into the bracket and connects the first gear, a housing of the air pump is connected with the bracket, the input shaft of the air pump extends into the bracket and connects the third gear, the first gear meshes with the second gear, the second gear meshes with the third gear, and wherein the engagement-disengagement handle is operable so as to move the second gear in an axial direction to engage with or disengage from the first gear, the engagement-disengagement handle is mounted on the bracket, and an operational end of the engagement-disengagement handle is located on a side of the second gear, and wherein the speed change mechanism is arranged between an output end of the transmission mechanism and the input shaft of the air pump, wherein the output end of the transmission mechanism, the speed change mechanism and the input shaft of the air pump are connected successively, and wherein the air pump is located above the side face of the motor, and an axis of the input shaft of the air pump is in parallel with an axis of the first output shaft of the motor, and wherein when the second gear is engaged with the first gear by the engagement-disengagement handle, the motor is operable to drive the air pump and the winching roller; and wherein when the second gear is disengaged from the first gear by the engagement-disengagement handle, the motor is operable to drive the winching roller.

2. An electric capstan comprising:

an air pump;

a motor;

a reduction gear;

a winching roller;

a clutch; and a lever, wherein an input shaft of the air pump is connected to or disconnected from a first output shaft of the motor by the clutch and the lever, and the lever is able to engage or disengage the clutch, the clutch has a groove, the lever at the end thereof has an eccentric and axial protrusion which can be embedded in the groove of the clutch, and the lever is rotatably attached to the housing of the clutch, and wherein the motor comprises a second output shaft that is connected to the winching roller, and wherein the air pump, the motor, the reduction gear, and winching roller are aligned in a same axis, and wherein when the input shaft of the air pump is connected to the first output shaft of the motor by the clutch and the lever, the motor is operable to drive the air pump and the winching roller; and wherein when the input shaft of the air pump is disconnected from the first output shaft of the motor by the clutch and the lever, the motor is operable to drive the winching roller.

3. An electric capstan comprising:

an air pump, a motor, a reduction gear, a winching roller, a transmission mechanism and an engagement-disengagement handle;

wherein an input shaft of the air pump is connected to or disconnected from a first output shaft of the motor by the engagement-disengagement handle, and wherein the motor comprises a second output shaft that is connected to the winching roller, and wherein the transmission mechanism comprises a bracket, a first gear, a second gear and a third gear, the bracket is connected to the housing of the motor, the first output shaft of the motor extends into the bracket and connects the first gear, a housing of the air pump is connected with the bracket, the input shaft of the air pump extends into the bracket and connects the third gear, the first gear meshes with the second gear, the second gear meshes with the third gear, and wherein the engagement-disengagement handle is operable so as to move the second gear in an axial direction to engage with or disengage from the first gear, the engagement-disengagement handle is mounted on the bracket, and an operational end of the engagement-disengagement handle is located on a side of the second gear, and wherein when the input shaft of the air pump is connected to the output shaft of the motor by the engagement-disengagement handle, the motor is operable to drive the air pump and the winching roller; and wherein when the input shaft of the air pump is disconnected from the output shaft of the motor by the engagement-disengagement handle, the motor is operable to drive the winching roller.

4. The electric capstan according to claim 3, wherein the engagement-disengagement handle is operable so as to move the second gear in an axial direction and further engage with or disengage from the first gear, and the engagement-disengagement handle is mounted on the bracket, and an operational end of the engagement-disengagement handle is located on the side of the second gear.

5. The electric capstan according to claim 4, further comprising a speed change mechanism arranged between the output end of the transmission mechanism and the input shaft of the air pump, wherein the output end of the transmission mechanism, the speed change mechanism, and the input shaft of the air pump are connected successively.

6. The electric capstan according to claim 3, wherein the air pump is located above the side face of the motor, and an axis of the input shaft of the air pump is in parallel with an axis of the first output shaft of the motor.

7. The electric capstan according to claim 1, wherein when the input shaft of the air pump is connected to the first output shaft of the motor by the clutch, the motor is operable to deliver power from the first output shaft of the motor to the input shaft of the air pump.

8. The electric capstan according to claim 1, wherein when the input shaft of the air pump is connected to the first output shaft of the motor by the engagement-disengagement handle, the motor and the air pump are connected via the transmission mechanism.

9. The electric capstan according to claim 8, wherein when the input shaft of the air pump is connected to the first output shaft of the motor by the engagement-disengagement handle, the winching roller and the transmission mechanism are connected via the motor.

10. The electric capstan according to claim 1, wherein the motor is arranged between the winching roller and the first, second, and third gears.

11. The electric capstan according to claim 3, wherein the motor is arranged between the winching roller and the first, second, and third gears.

12. The electric capstan according to claim 1, wherein the pump is affixed to the bracket on one end of the bracket and the motor is affixed to the bracket at another end of the bracket.

13. The electric capstan according to claim 3, wherein the pump is affixed to the bracket on one end of the bracket and the motor is affixed to the bracket at another end of the bracket.

* * * * *